US005752495A

United States Patent [19]

Tuller et al.

[11] Patent Number: 5,752,495

[45] Date of Patent: May 19, 1998

[54] SLINGSHOT BALL FEEDER

[75] Inventors: Jeffrey Tuller, Rochester; Jason L. Sweet, Fairport, both of N.Y.

[73] Assignee: Crosman Corporation, East Bloomfield, N.Y.

[21] Appl. No.: 798,986

[22] Filed: Feb. 11, 1997

[51] Int. Cl.[6] ..... F41B 3/02

[52] U.S. Cl. ..... 124/20.2; 124/51.1

[58] Field of Search ..... 124/20.1, 20.2, 124/49, 50, 51.1; 221/241, 242, 268, 270, 272

[56] References Cited

U.S. PATENT DOCUMENTS

| | | | |
|---|---|---|---|
| 1,258,018 | 3/1918 | Kilgore | 124/51.1 X |
| 1,602,358 | 10/1926 | Getskay | 124/50 X |
| 2,483,039 | 9/1949 | Davis | 124/50 |
| 2,596,870 | 5/1952 | Sanderson | 124/20.2 |
| 2,625,925 | 1/1953 | Osborne | 124/20.2 |
| 2,811,150 | 10/1957 | Marocchi | 124/51.1 X |
| 2,888,003 | 5/1959 | Swanson | 124/51.1 X |
| 3,270,734 | 9/1966 | Clements | 124/20.2 |
| 3,407,798 | 10/1968 | Rock | 124/20.2 |
| 3,556,071 | 1/1971 | Udesen | 124/16 |
| 3,572,311 | 3/1971 | Baer | 124/50 X |
| 3,618,585 | 11/1971 | Allison | 124/20.2 |
| 4,164,929 | 8/1979 | Liepins et al. | 124/50 X |
| 4,265,212 | 5/1981 | Wolf | 124/20.1 |
| 4,274,387 | 6/1981 | McBride | 124/20.2 |
| 4,583,513 | 4/1986 | Ellenburg | 124/20.2 |
| 4,831,998 | 5/1989 | Maguire, III | 124/50 |
| 5,044,350 | 9/1991 | Iwabuchi et al. | 124/51.1 |

*Primary Examiner*—John A. Ricci

[57] ABSTRACT

A ball feeder for a slingshot includes an elongated tube and a ball feeding housing at one end of the tube. The ball feeding housing has an outlet opening which is offset from the axis of the tube. A pair of plungers are reciprocably mounted in the ball feeding housing. Each of the plungers is provided with a ball opening having a diameter substantially the same as the diameter of the tube and an axial dimension less than the diameter of the tube. The total axial dimension of the ball opening is at least as great as the diameter of the bore. At least two different size balls can be fed by the ball feeder. The diameter of one size corresponds to the axial dimension of one of the plungers, and the diameter of the other size corresponds to the diameter of the tube.

12 Claims, 1 Drawing Sheet

SLINGSHOT BALL FEEDER

BACKGROUND AND SUMMARY

This invention relates to a ball feeder for a slingshot. More particularly, the invention relates to a ball feeder which is capable of feeding different sized balls.

Slingshots are designed to propel projectiles such as balls, shot, and the like. Some slingshots are equipped with magazines or devices for storing and delivering projectiles. For example, U.S. Pat. No. 4,265,212 describes one such device.

A device for storing and feeding projectiles should be capable of easy operation for delivering a projectile in a manner which facilitates loading the projectile in the sling of the slingshot. It is also desirable that the projectile feeder be capable of feeding different sized projectiles so that the user of the slingshot can operate the slingshot with more than one size of projectile.

The invention provides a ball feeder which can be removably attached to a slingshot. The ball feeder includes an elongated tube having an axially-extending bore. The tube includes a ball-feeding portion at one end of the tube having an outlet opening which is transversely offset from the axis of the tube. A pair of plungers are reciprocably mounted in the ball-feeding portion, and each plunger is provided with a ball opening. Each plunger is movable from a loading position in which the ball opening is axially aligned with the tube bore and a feeding position in which the ball opening is aligned with the outlet opening. The plunger adjacent the outlet opening includes a pushbutton for moving the plunger to the feeding position. The axial dimension of the plunger with the pushbutton corresponds generally to the diameter of one size of ball which can be used with the ball feeder. The combined axial dimension of both plungers corresponds generally to the diameter of another size of ball which can be used.

DESCRIPTION OF THE DRAWING

The invention will be explained in conjunction with an illustrative embodiment shown in the accompanying drawing, in which.

DESCRIPTION OF SPECIFIC EMBODIMENT

Figure 1:
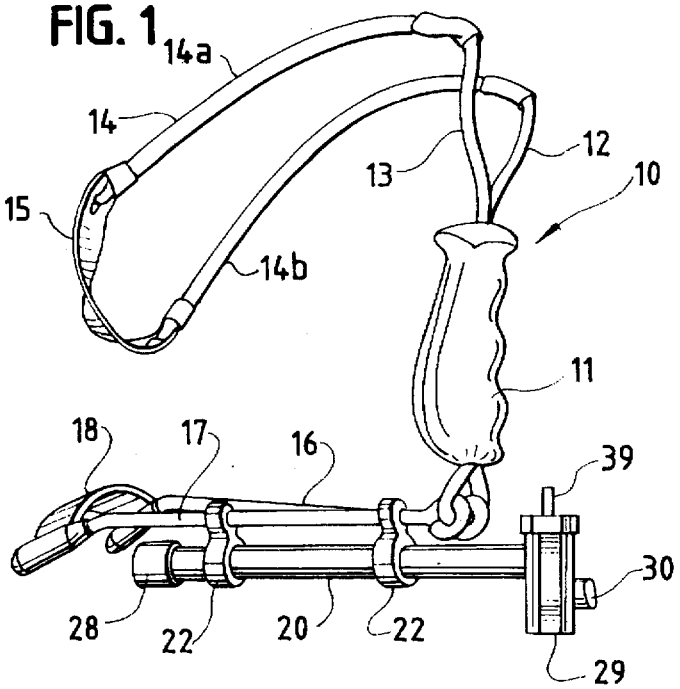
FIG. 1 is a perspective view of a slingshot which is equipped with a ball feeder in accordance with the invention.

Referring to FIG. 1, a slingshot 10 includes a handgrip 11, a pair of sling supports 12 and 13, and an elastic band or sling 14. Each of the sling supports includes a lower end which is secured within the handgrip and an upper end to which one end of the sling is attached. In the specific embodiment illustrated, the sling is provided by a pair of tubular sling portions **14*a* and 14*b*, each of which is attached to a pouch 15**.

A wrist brace 16 is attached to the bottom of the handgrip and includes a generally straight portion 17 and a bracing portion 18 which is designed to engage the forearm of the user.

The slingshot and the wrist brace may be conventional, and the details thereof are well known to those skilled in the art.

Figure 3:
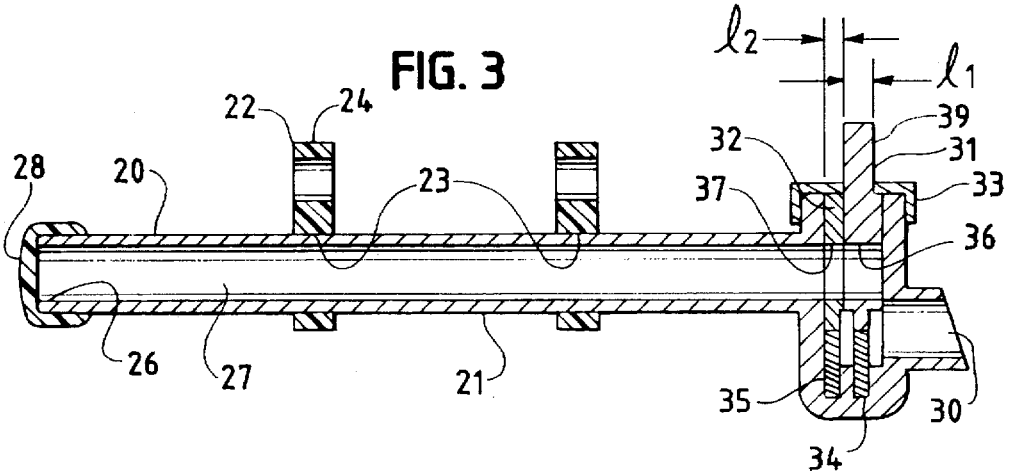
FIG. 3 is a longitudinal sectional view of the ball feeder.

A ball feeder 20 is mounted on the straight portion 17 of the wrist brace. The ball feeder includes an elongated tube 21 and a plurality of clips 22 for removably mounting a ball feeder on the wrist brace. Referring to FIG. 3, each clip is provided with an opening 23 through which the tube 21 extends and a hook portion 24 which snaps onto the wrist brace.

Still referring to FIG. 3, the tube 21 has an inlet end 26 and an axially extending bore 27. The inlet end is closed by a removable cap 28.

The other end of the tube includes a ball feeding housing 29 which extends transversely to the axis of the bore. The ball feeding housing is provided with an outlet opening 30 which is transversely offset from the axis of the bore.

A pair of plungers 31 and 32 are reciprocably mounted in the housing 28 and are retained by a cap 33. Springs 34 and 35 engage a stud or pin on the bottom of each of the plungers and resiliently bias the plungers against the cap.

The plunger 31 which is adjacent the outlet opening 30 has a ball opening 36, and the plunger 32 has a ball opening 37. The diameter of each of the openings is substantially the same as the diameter of the bore 27. However, the axial dimensions of the openings are different. The opening 36 has an axial dimension $l_1$ which is less than the diameter of the bore 27, and the opening 37 has an axial dimension $l_2$. In the particular embodiment illustrated, $l_2$ is less than $_1$. However, $l_2$ can be greater than or equal to $l_1$.

The plunger 31 includes a pushbutton 39 which extends through an opening in the cap 33. The springs 34 and 35 normally maintain the plungers in a loading position illustrated in FIG. 3 in which the openings 36 and 37 are aligned with the bore 27. The plunger 31 can be depressed to a ball feeding position in which the opening 36 is aligned with the outlet opening 30 by pushing the pushbutton 39.

Balls are loaded into the tube 21 by removing the end cap 28. At least two sizes of balls can be used with the ball feeder. The diameter of one size ball corresponds generally to the dimension $l_1$ of the opening 36. The diameter of the other size ball corresponds generally to the total of dimension $l_1$ plus the dimension 12.

The ball feeder is used by tilting the tube 21 so that the balls are gravity fed toward the feeder housing 29. A single ball is fed through the outlet opening 30 by depressing the pushbutton 39. If a small ball is positioned in the plunger opening 31, only the plunger 31 will be depressed by the pushbutton. The plunger 32 will remain stationary and will prevent a second ball from moving down with the plunger 31.

If a large ball is positioned in the opening 36, as the plunger 31 is depressed, the ball will engage the plunger 32 and cause the plunger 32 to move downwardly with the plunger 31. The side wall of the tube 21 will prevent a second ball from moving downwardly with the plunger.

Regardless of the size of the ball which is in the feeder housing, only a single ball is allowed to pass through the outlet opening 30. The pouch 15 of the sling can be positioned at the outlet opening 30 when the pushbutton is depressed so that the ball automatically feeds into the pouch.

In one specific embodiment, the diameter of the bore 27 and the openings 36 and 37 was ⅜ inch. The axial dimension $l_1$ was ¼ inch, and the axial dimension $l_2$ was ⅛ inch. The ball feeder was used with balls having diameters of ⅜ inch and ¼ inch.

It will be understood that the ball feeder can be used with more than two sizes of balls and that a range of ball sizes can be used. For example, balls having a diameter ranging from slightly greater than ½ $l_1$ to $l_1$ can be fed by depressing the plunger 31 without moving the plunger 32 and without feeding more than one ball at a time. Balls having a diameter ranging from slightly greater than $l_1$ to $l_1$ and $l_2$ can be fed by causing the plunger 32 to move downwardly when the plunger 31 is depressed.

Figure 4:
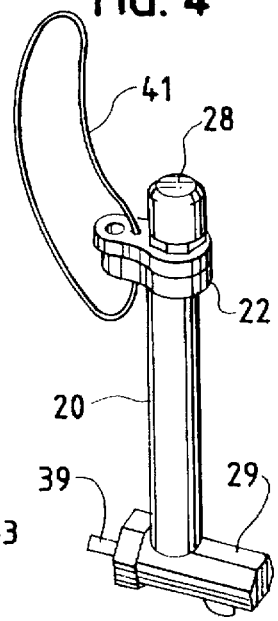
FIG. 4 is a perspective view of the ball feeder with a support loop.
Figure 2:
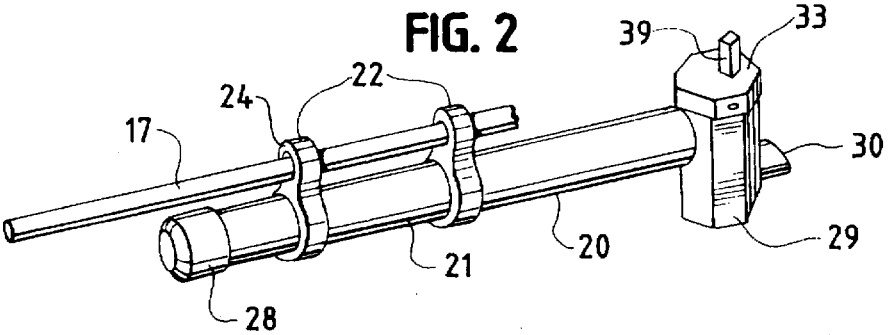
FIG. 2 is a perspective view of the ball feeder.

The ball feeder does not have to be mounted on a slingshot. For example, FIG. 4 illustrates the ball feeder 20 with a support loop 41 which extends through a hole in one or both of the clips 22. The support loop can be used to hang the ball feeder from a belt or the like.

While in the foregoing specification a detailed description of specific embodiments of the invention was set forth for the purpose of illustration, it will be understood that many of the details herein given can be varied considerably by those skilled in the art without departing from the spirit and scope of the invention.

We claim:

1. A ball feeder for a slingshot comprising:

an elongated tube having first and second ends and a longitudinally extending bore having a longitudinal axis, means at the first end of the tube for opening and closing the first end of the tube, an exit port positioned adjacent the second end of the tube and offset from the axis of the bore of the tube, a plunger reciprocably mounted relative to the tube for reciprocation transverse to the longitudinal axis of the tube, the plunger having a ball opening and being movable between a first position in which the ball opening is aligned with the bore of the tube and a second position in which the ball opening is aligned with the exit port, said ball opening having a diameter which extends transversely to the longitudinal axis of the bore and an axial dimension which extends parallel to the longitudinal axis of the bore, the axial dimension of the ball opening being less than the diameter of the ball opening, and a second plunger reciprocably mounted adjacent the first plunger for reciprocation parallel to the reciprocation of the first plunger, the second plunger having a ball opening and being movable between a first position in which the ball opening is aligned with the bore of the tube and a second position in which the ball opening is aligned with the exit port, the ball opening of the second plunger having a diameter which extends transversely to the longitudinal axis of the bore and an axial dimension which extends parallel to the axial dimension of the bore, the diameters of the ball openings of the first and second plungers being substantially the same as the diameter of the bore of the tube and the total axial dimension of the ball openings of the first and second plungers being at least as great as the diameter of the bore.

2. The ball feeder of claim 1 in which said first-mentioned plunger includes a pushbutton which extends externally of the tube whereby the first-mentioned plunger can be moved from its first position to its second position by depressing the plunger.

3. The ball feeder of claim 1 including first and second spring means for resiliently biasing the first-mentioned plunger and the second plunger, respectively, toward their first positions.

4. A ball feeder for a slingshot comprising:

an elongated tube having first and second ends and a longitudinal extending bore having a longitudinal axis, means at the first end of the tube for opening and closing the first end of the tube, the second end of the tube having an offset portion which is provided with an outlet opening which is transversely offset from the longitudinal axis of the tube, first and second plungers reciprocably mounted in the offset portion of the tube for reciprocation transverse to the longitudinal axis of the tube, each of the plungers having a ball opening and being movable between a first position in which the ball opening is aligned with the bore of the tube and a second position in which the ball opening is aligned with the outlet opening, the ball opening of each of the plungers having a diameter which extends transversely to the longitudinal axis of the bore and which is substantially the same as the diameter of the bore, the ball opening of the first plunger having an axial dimension which extends parallel to the longitudinal axis of the bore and which is less than the diameter of the bore, the ball opening of the second plunger having an axial dimension which extends parallel to the longitudinal axis of the bore, the total axial dimension of the ball openings of the first and second plungers being at least as great as the diameter of the bore.

5. The ball feeder of claim 4 in which the first plunger includes a pushbutton which extends externally of the tube whereby the first plunger can be moved from its first position to its second position by depressing the plunger.

6. The ball feeder of claim 4 including first and second spring means for resiliently biasing the first and second plungers, respectively, toward their first positions.

7. The ball feeder of claim 4 in which the axial dimension of the ball opening of the first plunger is more than one-half of the diameter of the bore.

8. A slingshot comprising:

a handgrip having top and bottom ends, a pair of sling supports extending from the top end of the handgrip, an elastic sling attached to the band supports, an elongated wrist brace extending from the bottom end of the handgrip, an elongated tube attached to the wrist brace and having first and second ends and a longitudinal extending bore having a longitudinal axis, means at the first end of the tube for opening and closing the first end of the tube, an exit port positioned adjacent the second end of the tube and offset from the axis of the bore of the tube, a plunger reciprocably mounted relative to the tube for reciprocation transverse to the longitudinal axis of the tube, the plunger having a ball opening and being movable between a first position in which the ball opening is aligned with the bore of the tube and a second position in which the ball opening is aligned with the exit port.

9. The slingshot of claim 8 in which the plunger includes a pushbutton which extends externally of the tube whereby the plunger can be moved from its first position to its second position by depressing the plunger.

10. A slingshot comprising:

a handgrip having top and bottom ends, a pair of sling supports extending from the top end of the handgrip, an elastic sling attached to the band supports, an elongated wrist brace extending from the bottom end of the handgrip, an elongated tube having first and second ends and a longitudinal extending bore having a longitudinal axis, means at the first end of the tube for opening and closing the first end of the tube, the second end of the tube having an offset portion which is provided with an outlet opening which is transversely offset from the longitudinal axis of the tube, first and second plungers reciprocably mounted in the offset portion of the tube for reciprocation transverse to the longitudinal axis of the tube, each of the plungers having a ball opening and being movable between a first position in which the ball opening is aligned with the bore of the tube and a second position in which the ball opening is aligned with the outlet opening, the ball opening of each of the plungers having a diameter which extends transversely to the longitudinal axis of the bore and which is substantially the same as the diameter of the bore, the ball opening of the first plunger having an axial dimension which extends parallel to the longitudinal axis of the bore and which is less than the diameter of the bore, the ball opening of the second plunger having an axial dimension which extends parallel to the longitudinal axis of the bore, the total axial dimension of the ball openings of the first and second plungers being at least as great as the diameter of the bore.

11. The slingshot of claim 10 in which the first plunger includes a pushbutton which extends externally of the tube whereby the first plunger can be moved from its first position to its second position by depressing the plunger.

12. The slingshot of claim 10 including first and second spring means for resiliently biasing the first and second plungers, respectively, toward their first positions.

* * * * *